US009671804B2

(12) United States Patent
Kronmueller et al.

(10) Patent No.: US 9,671,804 B2
(45) Date of Patent: Jun. 6, 2017

(54) LEAKAGE REDUCTION TECHNIQUE FOR LOW VOLTAGE LDOS

(71) Applicant: Dialog Semiconductor GmbH, Kirchheim/Teck-Nabern (DE)

(72) Inventors: Frank Kronmueller, Neudenau (DE); Ambreesh Bhattad, Swindon (GB); Burak Dundar, Istanbul (TR)

(73) Assignee: Dialog Semiconductor (UK) Limited, London (GB)

( * ) Notice: Subject to any disclaimer, the term of this patent is extended or adjusted under 35 U.S.C. 154(b) by 81 days.

(21) Appl. No.: 14/547,229

(22) Filed: Nov. 19, 2014

(65) Prior Publication Data

US 2016/0018834 A1 Jan. 21, 2016

(30) Foreign Application Priority Data

Jul. 17, 2014 (DE) ..... 10 2014 213 963

(51) Int. Cl.
*G05F 1/575* (2006.01)
*G05F 1/46* (2006.01)
*G05F 1/569* (2006.01)

(52) U.S. Cl.
CPC ..... *G05F 1/575* (2013.01); *G05F 1/468* (2013.01); *G05F 1/569* (2013.01)

(58) Field of Classification Search
CPC . G05F 1/56; G05F 1/565; G05F 1/569; G05F 1/575
See application file for complete search history.

(56) References Cited

U.S. PATENT DOCUMENTS 9,058,046 B1 * 6/2015 Pilo ..... G05F 3/267
2005/0134537 A1 6/2005 Tobita
2008/0203983 A1 8/2008 Lo Lacono et al.
2009/0224737 A1 9/2009 Lou
(Continued)

OTHER PUBLICATIONS

German Office Action 10 2014 213 963.5, Oct. 22, 2014, Dialog Semiconductor GmbH.
(Continued)

*Primary Examiner* — Harry Behm
*Assistant Examiner* — Peter Novak
(74) *Attorney, Agent, or Firm* — Saile Ackerman LLC; Stephen B. Ackerman

(57) ABSTRACT

The present document relates to multi-stage amplifiers, such as linear regulators (e.g. low-dropout regulators). A method and a circuit for reducing leakage current of such multi-stage amplifiers is presented. A voltage regulator is described. The voltage regulator comprises a pass device configured to provide a load current at a regulated output voltage to an output node of the voltage regulator. A source of the pass device is coupled to a first potential of the voltage regulator. Furthermore, the voltage regulator comprises drive circuitry configured to control the pass device via a gate of the pass device, based on a reference voltage and based on a feedback voltage derived from the output voltage. In addition, the voltage regulator comprises leakage reduction circuitry configured to pull-up the gate of the pass device using a second potential; wherein the second potential is higher than the first potential.

20 Claims, 7 Drawing Sheets

(56) References Cited

U.S. PATENT DOCUMENTS

| | | | | |
|---|---|---|---|---|
| 2010/0148735 | A1* | 6/2010 | Napravnik | G05F 1/575 323/280 |
| 2013/0265020 | A1 | 10/2013 | Krenzke | |
| 2014/0117952 | A1* | 5/2014 | Li | G05F 1/565 323/271 |

OTHER PUBLICATIONS

Translation of German Office Action, Jan. 2016.
"A CMOS Scheme for 0.5V Supply Voltage with Pico-Ampere Standby Current," by Hiroshi Kawaguchi, et al., Solid-State Circuits Conference, 1998 IEEE International Digest of Technical Papers, Feb. 5-7, 1998, pp. 192-193.
"Leakage Current Mechanisms and Leakage Reduction Techniques in Deep-Submicrometer CMOS Circuits," by Kaushik Roy, et al., Proceedings of the IEEE, vol. 91, No. 2, Feb. 2003, pp. 305-327.

* cited by examiner

LEAKAGE REDUCTION TECHNIQUE FOR LOW VOLTAGE LDOS

TECHNICAL FIELD

The present document relates to multi-stage amplifiers, such as linear regulators or linear voltage regulators (e.g. low-dropout regulators). In particular, the present document relates to a method and a circuit for reducing leakage current of such multi-stage amplifiers or voltage regulators.

BACKGROUND

An example of multi-stage amplifiers or voltage regulators are low-dropout (LDO) regulators which are linear voltage regulators which can operate with small input-output differential voltages. A typical LDO regulator 100 is illustrated in FIG. 1*a*. The LDO regulator 100 comprises an output amplification stage 103, e.g. a field-effect transistor (FET), at the output and a differential amplification stage or differential amplifier 101 (also referred to as an error amplifier) at the input. A first input (fb) 107 of the differential amplifier 101 receives a fraction of the output voltage $V_{out}$ determined by the voltage divider 104 comprising resistors R0 and R1. The second input (ref) to the differential amplifier 101 is a stable voltage reference $V_{ref}$ 108 (also referred to as the bandgap reference). If the output voltage $V_{out}$ changes relative to the reference voltage $V_{ref}$, the drive voltage to the output amplification stage, e.g. to the power FET (field effect transistor), changes by a feedback mechanism called main feedback loop to maintain a constant output voltage $V_{out}$.

The LDO regulator 100 of FIG. 1*a* further comprises an additional intermediate amplification stage 102 configured to amplify the output voltage of the differential amplification stage 101. As such, an intermediate amplification stage 102 may be used to provide an additional gain within the amplification path. Furthermore, the intermediate amplification stage 102 may provide a phase inversion.

In addition, the LDO regulator 100 may comprise an output capacitance $C_{out}$ (also referred to as output capacitor or stabilization capacitor or bypass capacitor) 105 parallel to the load 106. The output capacitor 105 may be used to stabilize the output voltage $V_{out}$ subject to a change of the load 106, in particular subject to a change of the load current $I_{load}$. It should be noted that typically the output current $I_{out}$ at the output of the output amplification stage 103 corresponds to the load current $I_{load}$ through the load 106 of the regulator 100 (apart from typically minor currents through the voltage divider 104 and the output capacitor 105). Consequently, the terms output current $I_{out}$ and load current $I_{load}$ are used synonymously, if not specified otherwise.

Typically, it is desirable to provide a stable output voltage $V_{out}$, even subject to transients of the load 106. By way of example, the regulator 100 may be used to provide a stable output voltage $V_{out}$ to the processor of an electronic device (such as a smartphone). The load current $I_{load}$ may vary significantly between a sleep state and an active state of the processor, thereby varying the load 106 of the regulator 100. In order to ensure a reliable operation of the processor, the output voltage $V_{out}$ should remain stable, even in response to such load transients.

At the same time, the LDO regulator 100 should be able to react rapidly to load transients, i.e. the LDO regulator 100 should be able to rapidly provide the requested load current $I_{load}$, subject to a load transient. This means that the LDO regulator 100 should exhibit a high bandwidth.

The regulator 100 shown in FIG. 1*a* is an example of a multi-stage amplifier. The output stage 103 of such a multi-stage amplifier or regulator 100 may exhibit leakage currents, even when the output stage 103 is in OFF state. Such leakage currents may lead to excessive power consumption, to overvoltage events at the output node of the multi-stage amplifier 100 and/or to a loss of regulation of the multi-stage amplifier 100.

SUMMARY

The present document is directed at providing circuitry which is configured to reduce and/or to compensate leakage current at the output of a multi-stage amplifier. According to an aspect, a multi-stage amplifier or voltage regulator, e.g. a linear regulator or low-dropout regulator, is described. The voltage regulator comprises a pass device (e.g. a power transistor) which may be configured to source a load current at an output voltage to an output node of the voltage regulator. The pass device may comprise or may be implemented as a P-type metaloxide semiconductor, referred to as MOS, transistor. The load current may be provided to a load of the voltage regulator, if the load is coupled to the output node. The load current may be drawn from a first (high) potential (e.g. from a supply voltage $V_{SUPPLY}$) of the voltage regulator. For this purpose, a source of the pass device may be (directly) coupled to the first potential and a drain of the pass device may be (directly) coupled to the output node. The load current may correspond to the source-drain current through the pass device.

The multi-stage amplifier further comprises drive circuitry which is configured to control the pass device based on a reference voltage and based on a feedback voltage, wherein the feedback voltage is derived from the output voltage (e.g. is proportional to the output voltage). The feedback voltage may be derived from the output voltage using a voltage divider. The reference voltage may be used to set the desired level of the output voltage. The drive circuitry may be configured to generate a gate voltage for a gate of the pass device, based on the reference voltage and based on the feedback voltage. In particular, the gate voltage may be derived based on a difference of the reference voltage and the feedback voltage. The gate voltage may be (directly) applied to the gate of the pass device.

In addition, the voltage regulator comprises leakage reduction circuitry which is configured to pull-up or to offset the gate and/or the gate voltage of the pass device using a second potential (referred to herein as the core voltage $V_{CORE}$). By way of example, the leakage reduction circuitry may comprise a current source which couples the gate of the pass device to the second potential. The current source may be configured to provide a fixed current. Alternatively or in addition, the leakage reduction circuitry may comprise a resistor which couples the gate of the pass device to the second potential.

The second potential is higher than the first potential. As a result of this, the leakage reduction circuitry may be configured to offset a source-gate voltage at the pass device by a negative offset, wherein the negative offset depends on the second potential and on the first potential, e.g. on a difference between the second potential and the first potential. In other words, the source-gate voltage at the pass device is pushed further below the threshold voltage of the pass device. By offsetting the gate of the pass device using a second potential which is higher than the first potential, the leakage of the pass device may be reduced, notably at relatively low load currents.

The voltage regulator may further comprise a differential amplification stage which is configured to derive a first intermediate voltage at a stage output node of the differential amplification stage, based on a difference between the reference voltage and the feedback voltage. The leakage compensation circuitry is configured to sink a current from the output node to a reference potential (e.g. ground) of the voltage regulator, wherein an amount of current, which is sunk by the leakage compensation circuitry depends on the first intermediate voltage. As such, efficient and adaptive means for compensating the (remaining) leakage of the pass device may be provided. The leakage compensation circuitry is integrated within the regulation loop of the voltage regulator, thereby adapting the current which is sunk by the leakage compensation circuitry to the operation point of the voltage regulator.

In particular, the leakage compensation circuitry may comprise a sink transistor (e.g. an N-type MOS transistor) which is arranged between the output node and the reference potential of the voltage regulator. A gate of the sink transistor may be coupled to the stage output node of the differential amplification stage, thereby controlling the amount of current which is sunk by the leakage compensation circuitry.

The voltage regulator may further comprise an intermediate amplification stage which is configured to derive a second intermediate voltage at a stage output node of the intermediate amplification stage, based on the first intermediate voltage. The intermediate amplification stage may provide for an additional gain and/or for a phase inversion. The drive circuitry may be coupled to the stage output node of the intermediate amplification stage. In particular, the drive circuitry may comprise an input transistor and a drive transistor (implemented e.g. as N-type MOS transistors). A gate of the input transistor may be coupled to the stage output node of the intermediate amplification stage. The input transistor and the drive transistor may be arranged in series and a gate of the drive transistor may be coupled to the gate of the pass device, in order to control the pass device.

As indicated above, the drive circuitry may comprise a drive transistor (arranged e.g. as a transistor diode) which forms a current mirror in conjunction with the pass device. The drive transistor and/or the pass device may comprise a bulk. The voltage regulator may comprise one or more bulk switches which are configured to couple the bulk of the drive transistor to the first potential and/or to the second potential. In particular, the voltage regulator may comprise logic circuitry which is configured to control the one or more bulk switches such that the bulk of the drive transistor and/or the pass device is coupled to the first potential, when the voltage regulator is in ON state, and to the second potential, when the voltage regulator is in OFF state. By doing this, leakage of the pass device may be eliminated, when the voltage regulator is in OFF stage.

The voltage regulator may further comprise an output capacitor arranged between the output node and the reference potential of the voltage regulator, in order to further stabilize the output voltage at the output node.

According to a further aspect, a method for reducing leakage of a pass device of a voltage regulator is described. The method comprises providing a load current at a regulated output voltage to an output node of the voltage regulator using a pass device, wherein a source of the pass device is coupled to a first potential of the voltage regulator. Furthermore, the method comprises controlling the pass device via a gate of the pass device, based on a reference voltage and based on a feedback voltage derived from the output voltage. In addition, the method comprises pulling-up or offsetting the gate of the pass device using a second potential, wherein the second potential is higher than the first potential.

According to a further aspect, a voltage regulator or a multi-stage amplifier is described. The voltage regulator comprises a pass device which is configured to provide a load current at a regulated output voltage to an output node of the voltage regulator. Furthermore, the voltage regulator comprises drive circuitry which is configured to control the pass device via a gate of the pass device, based on a reference voltage and based on a feedback voltage derived from the output voltage. In addition, the voltage regulator comprises a differential amplification stage which is configured to derive a first intermediate voltage at a stage output node of the differential amplification stage, based on a difference between the reference voltage and feedback voltage. Furthermore, the voltage regulator comprises leakage compensation circuitry which is configured to sink a current from the output node to a reference potential of the voltage regulator. An amount of current, which is sunk by the leakage compensation circuitry depends on the first intermediate voltage. As such, efficient and adaptive means for compensating the (remaining) leakage of the pass device may be provided. The leakage compensation circuitry is integrated within the regulation loop of the voltage regulator, thereby adapting the current which is sunk by the leakage compensation circuitry to the operation point of the voltage regulator.

It should be noted that the methods and systems including its preferred embodiments as outlined in the present document may be used stand-alone or in combination with the other methods and systems disclosed in this document. In addition, the features outlined in the context of a system are also applicable to a corresponding method. Furthermore, all aspects of the methods and systems outlined in the present document may be arbitrarily combined. In particular, the features of the claims may be combined with one another in an arbitrary manner.

In the present document, the term "couple" or "coupled" refers to elements being in electrical communication with each other, whether directly connected e.g., via wires, or in some other manner.

BRIEF DESCRIPTION OF THE DRAWINGS

The invention is explained below in an exemplary manner with reference to the accompanying drawings, wherein.

DESCRIPTION

Figure 1A:
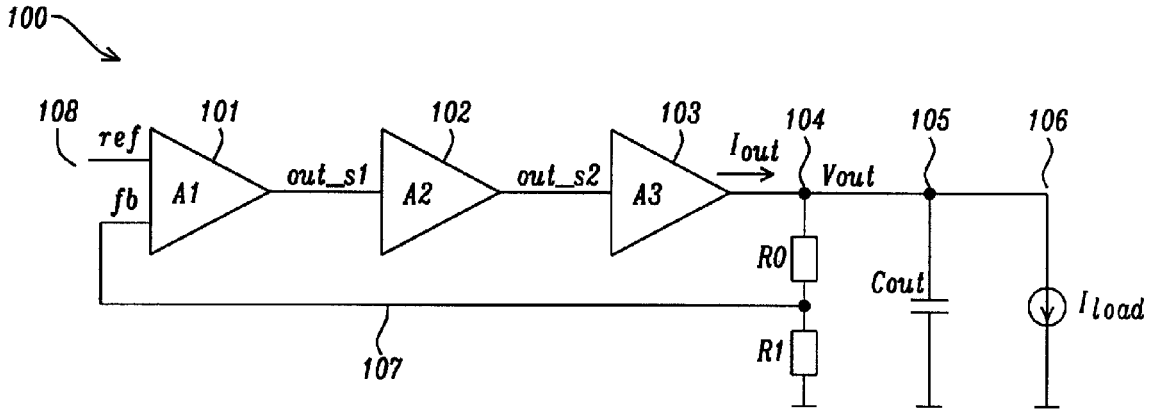
FIG. 1*a* illustrates an example block diagram of an LDO regulator.
Figure 1B:
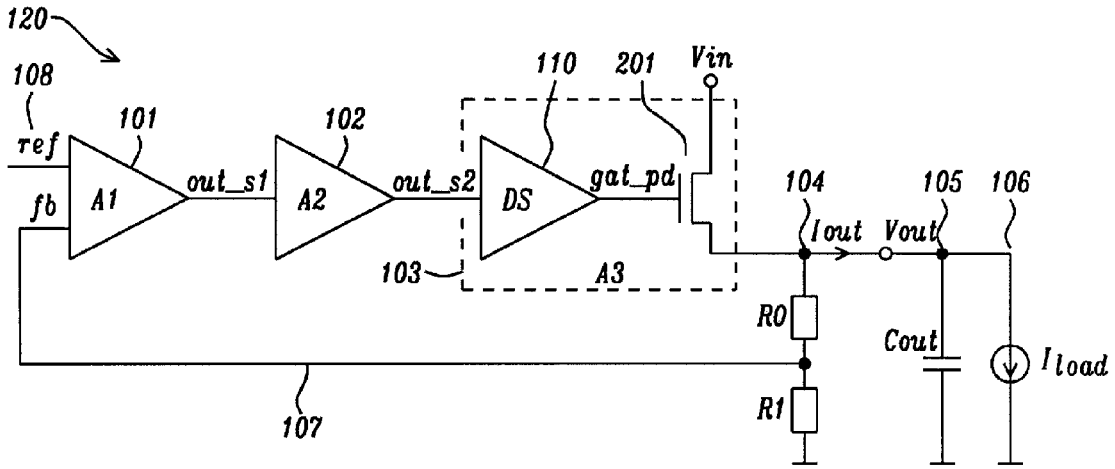
FIG. 1*b* illustrates the example block diagram of an LDO regulator in more detail.

As already outlined above, FIG. 1*a* shows an example block diagram for an LDO regulator 100 with its three amplification stages A1, A2, A3 (reference numerals 101, 102, 103, respectively). FIG. 1*b* illustrates the block diagram of a LDO regulator 120, wherein the output amplification stage A3 (reference numeral 103) is depicted in more detail. In particular, the pass transistor or pass device 201 and the driver stage 110 of the output amplification stage 103 are shown. Typical parameters of an LDO regulator are a supply voltage of 3V, an output voltage of 2V, and an output current or load current ranging from 1 mA to 100 or 200 mA. Other configurations are possible. The present invention is described in the context of a linear regulator. It should be noted, however, that the present invention is applicable to multi-stage amplifiers or voltage regulators in general.

It is desirable to provide a multi-stage amplifier such as the regulator 100, 120, which is configured to generate a stable output voltage $V_{out}$ subject to load transients. The output capacitor 105 may be used to stabilize the output voltage $V_{out}$, because in case of a load transient, an additional load current $I_{load}$ may be provided by the output capacitor 105. Furthermore, schemes such as Miller compensation and/or load current dependent compensation may be used to stabilize the output voltage $V_{out}$.

Figure 2:
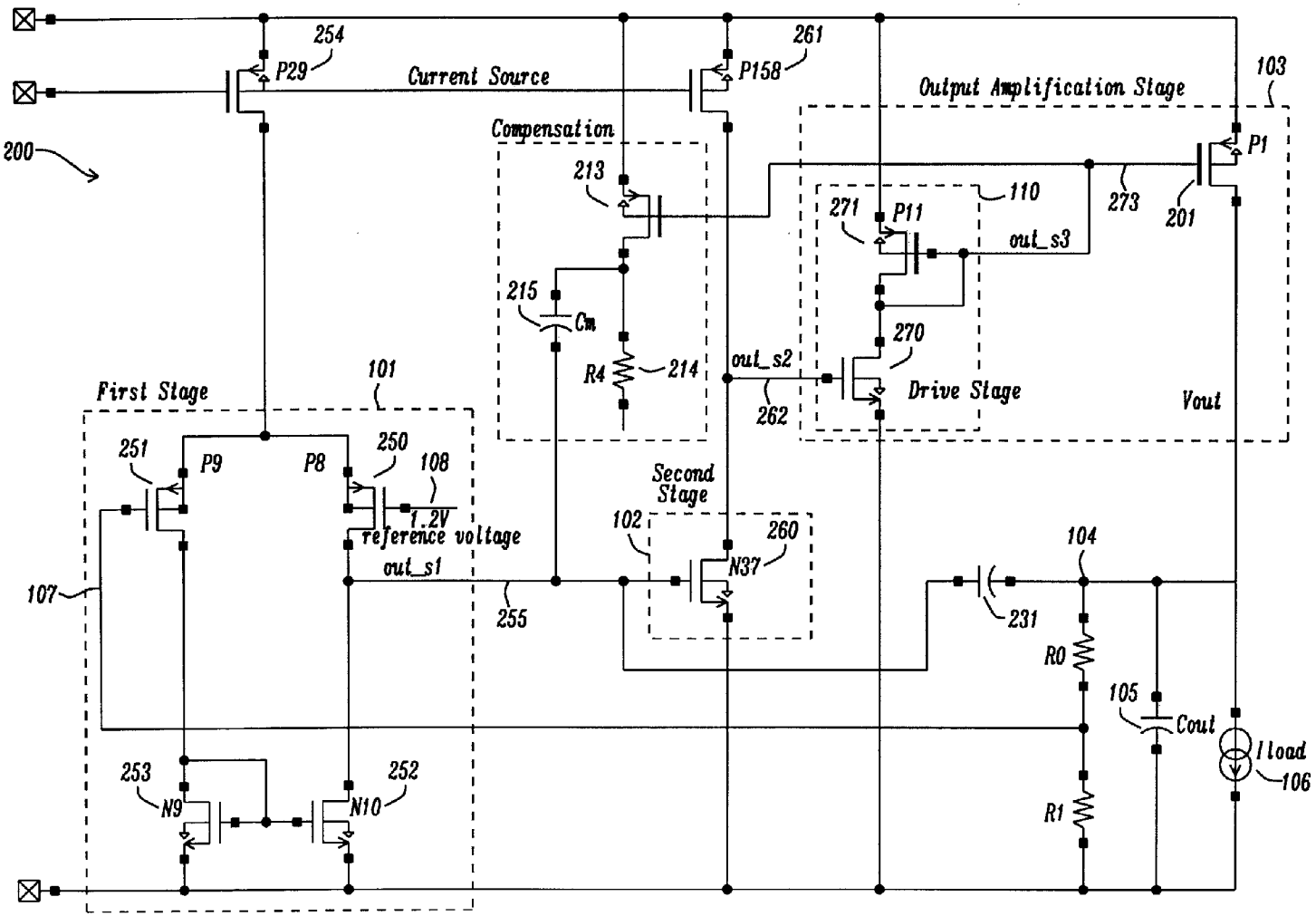
FIG. 2 shows an example circuit arrangement of an LDO regulator.

FIG. 2 illustrates an example circuit arrangement of an LDO regulator 200 comprising a Miller compensation using a capacitance $C_V$ 231 and a load current dependent compensation comprising a current mirror with transistors 201 (corresponding to the pass transistor 201) and 213, a compensation resistor 214 and a compensation capacitance $C_m$ 215.

The circuit implementation of FIG. 2 can be mapped to the block diagrams in FIGS. 1*a* and 1*b*, as similar components have received the same reference numerals. In the circuit arrangement 200, the differential amplification stage 101, the intermediate amplification stage 102 and the output stage 103 are implemented using field effect transistors (FET), e.g. metal oxide semiconductor FETs (MOSFETs).

The differential amplification stage 101 comprises the differential input pair of transistors P9 251 and P8 250, and the current mirror N9 253 and N10 252. The input of the differential pair is e.g. a 1.2V reference voltage 108 at P8 and the feedback 107 at P9 which is derived from the resistive divider 104 (with e.g. R0=0.8 MΩ and R1=1.2 MΩ).

The intermediate amplification stage 102 comprises a transistor N37 260, wherein the gate of transistor N37 260 is coupled to the stage output node 255 of the differential amplification stage 101. The transistor P158 261 acts as a current source for the intermediate amplification stage 102, similar to transistor P29 254 which acts as a current source for the differential amplification stage 101.

The output stage 103 is coupled to the stage output node 262 of the intermediate amplification stage 102 and comprises a pass device or pass transistor 201 and a gate driver stage 110 (also referred to as drive circuitry) for the pass device 201, wherein the gate driver stage comprises a transistor 270 and a transistor P11 271 connected as a diode. This gate driver stage has essentially no gain since it is low-ohmic through the transistor diode P11 271 which yields a resistance of $1/g_m$ (output resistance of the driver stage 110 of the output amplification stage 103) to signal ground. The gate of the pass transistor 201 is identified in FIG. 2 with reference numeral 273.

Multi-stage amplifiers or regulators 200 (notably the pass device 201 of such amplifiers) may be exhibit leakage currents. Notably for low voltage multi-stage amplifiers 200 (e.g. LDOs), low voltage transistors are used as pass devices 201 due to performance constraints. However, these low voltage transistors (e.g. MOSFETs) typically exhibit substantially higher leakage currents compared to 5V transistors, which are used in other high voltage multi-stage amplifiers. Furthermore, at relatively high temperatures leakage currents typically increase exponentially, thereby leading to excessive power consumption, overvoltage events and/or loss of regulation of the multi-stage amplifier.

Figure 3:
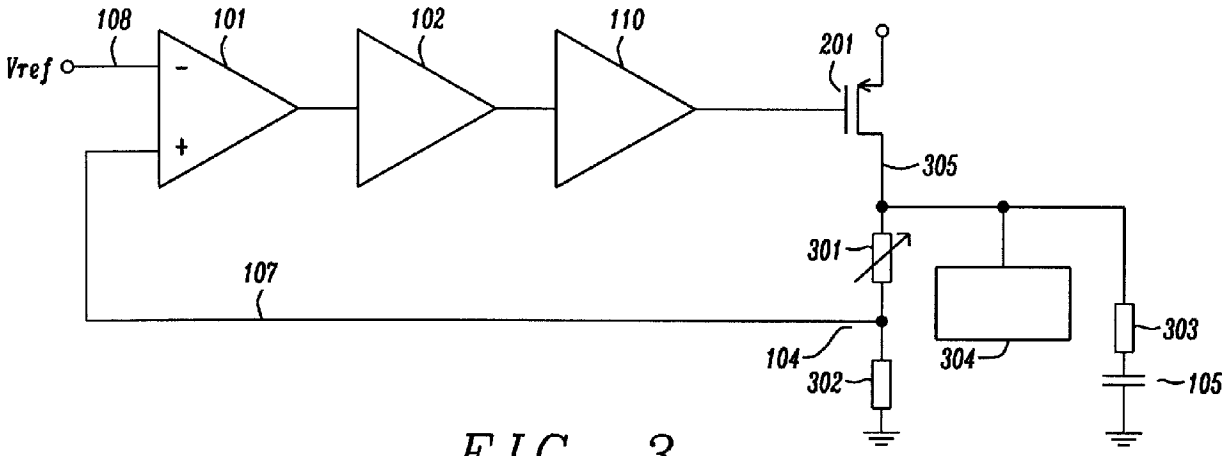
FIG. 3 shows an example LDO regulator comprising a leakage compensation circuit.

A possible approach to overcome consequences of leakage is to compensate the leakage currents. An example multi-stage amplifier which comprises a leakage compensation circuit 304 is illustrated in FIG. 3. As already outlined above, the multi-stage amplifier typically comprises a voltage divider 104 (with the resistors 301, 302) for generating the feedback voltage 107, and an output capacitor 105 (which typically exhibits an equivalent serial resistance, ESR, 303). The leakage compensation circuit 304 may be configured to pull or sink a current from the output node 305 of the multi-stage amplifier. The current which is drawn by the leakage compensation circuit 304 may mimic the leakage behaviour of the pass device 301. A PTAT (proportional to absolute temperature) current may be used to mimic the exponential characteristic of leakage with respect to temperature.

Using such a leakage compensation circuit 304, the effects of leakage with regards to the generation of an overvoltage situation at the output node 305 and with regards to the regulation of the multi-stage amplifier may be compensated. However, the leakage compensation circuit 304 does not prevent the occurrence of leakage. As a result of this, the multi-stage amplifier still exhibits unnecessary power consumption. Furthermore, the leakage compensation circuit 304 is not embedded within the feedback loop of the multi-stage amplifier. The current which is drawn by the leakage compensation circuit 304 is pre-designed based on measured characteristics of the pass device 201. An automatic regulation of the leakage current which is to be regulated does not occur. In particular, the leakage compensation circuit 304 of FIG. 3 is not able to track leakage characteristics over process corner variations of the pass device 201. The leakage compensation circuit 304 is typically designed according to a worst case process corner with regards to leakage. Such a worst case design leads to unnecessary power consumption at other process corners.

Figure 4:
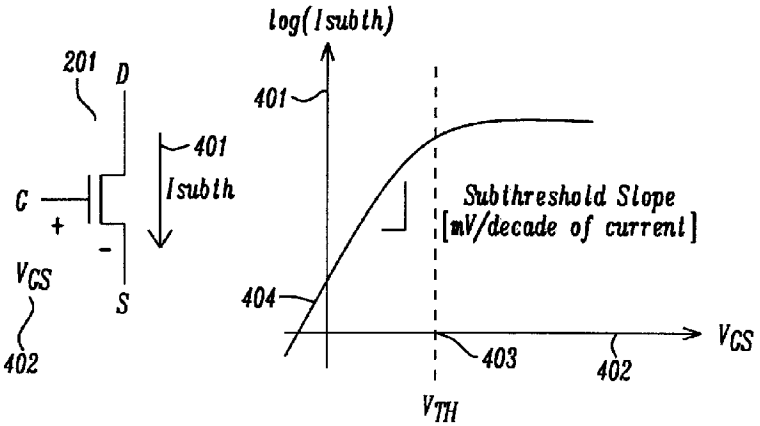
FIG. 4 shows an example relationship between the leakage current and the source-gate voltage $V_{GS}$ of a pass device.

As shown in FIG. 4, the amount of leakage current 401 of a transistor 201 (e.g. a MOSFET) typically depends on the level of the source-gate voltage $V_{GS}$ 402. A lower $V_{GS}$ voltage 402 typically leads to lower leakage current values 401. By making $V_{GS}$ 402 negative, the leakage current 401 of a transistor 201 may be further reduced. This is shown by the leakage current curve 404. As can be seen, the leakage current 401 reduces as the source-gate voltage 402 is reduced (even below the threshold voltage $V_{TH}$ 403 of the pass device 201, and even when using negative source-gate voltages 402).

Figure 5:
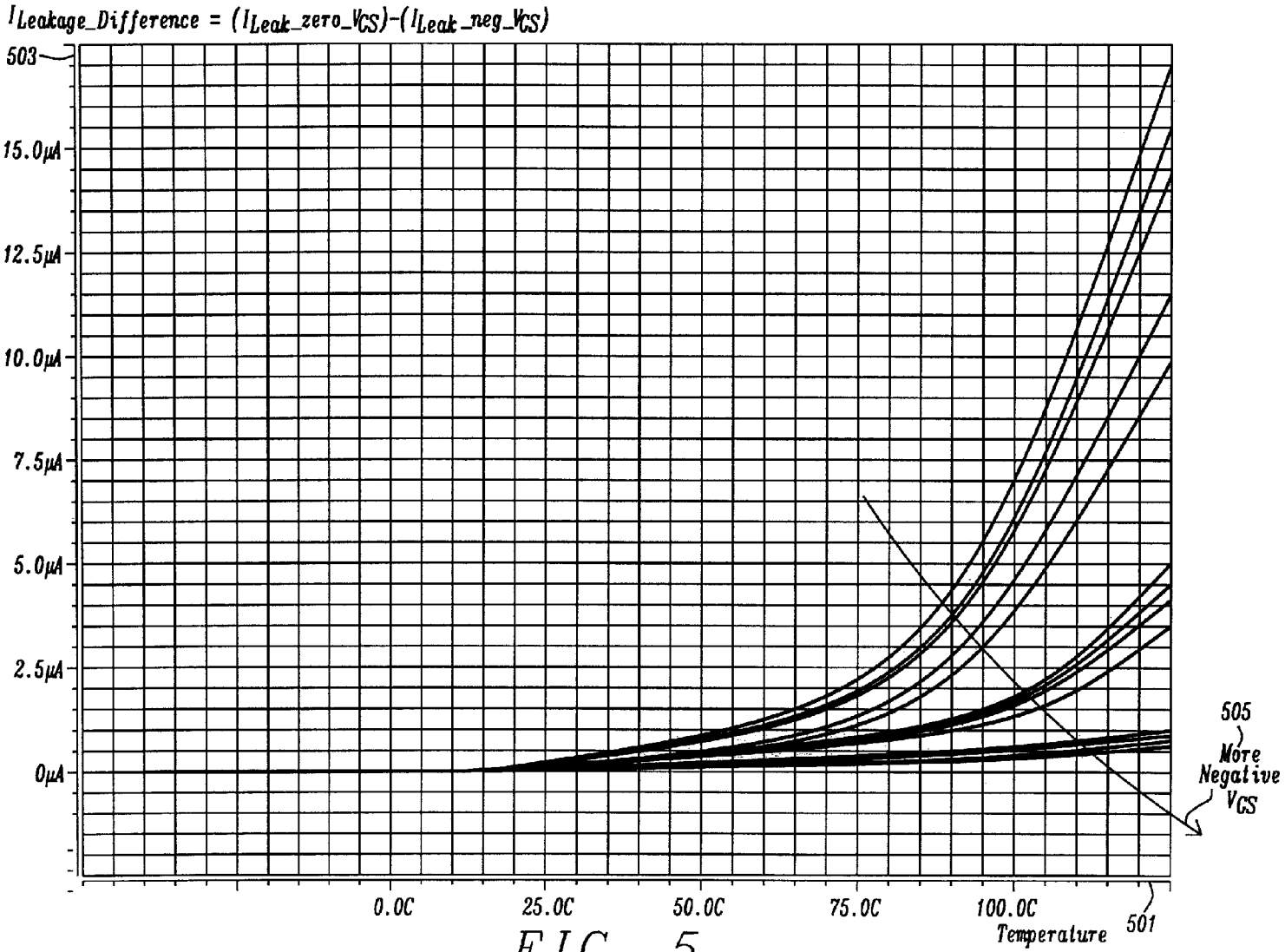
FIG. 5 shows example leakage currents as a function of the temperature of the pass device.

Experimental results have been gathered using an example pass device 201 within a 0.13μ process (see FIG. 5). The leakage current 401 as a function of temperature 501 has been observed for different levels of the output voltage and for different gate-source voltages $V_{GS}$ (for $V_{GS}$=0V and for a negative source-gate voltage). FIG. 5 shows the reduction 505 of leakage current 503 $I_{LEAKAGE_DIFFERENCE}=I_{LEAK_ZERO_VGS}-I_{LEAK_NEG_VGS}$ which is achieved by applying a negative voltage $V_{GS}$ instead of a voltage $V_{GS}$=0V. It can be observed that notably for relatively high temperatures, significant reductions 503 of leakage current 401 may be achieved when applying a negative source-gate voltage $V_{GS}$ 402 to the pass device 201.

Figure 6:
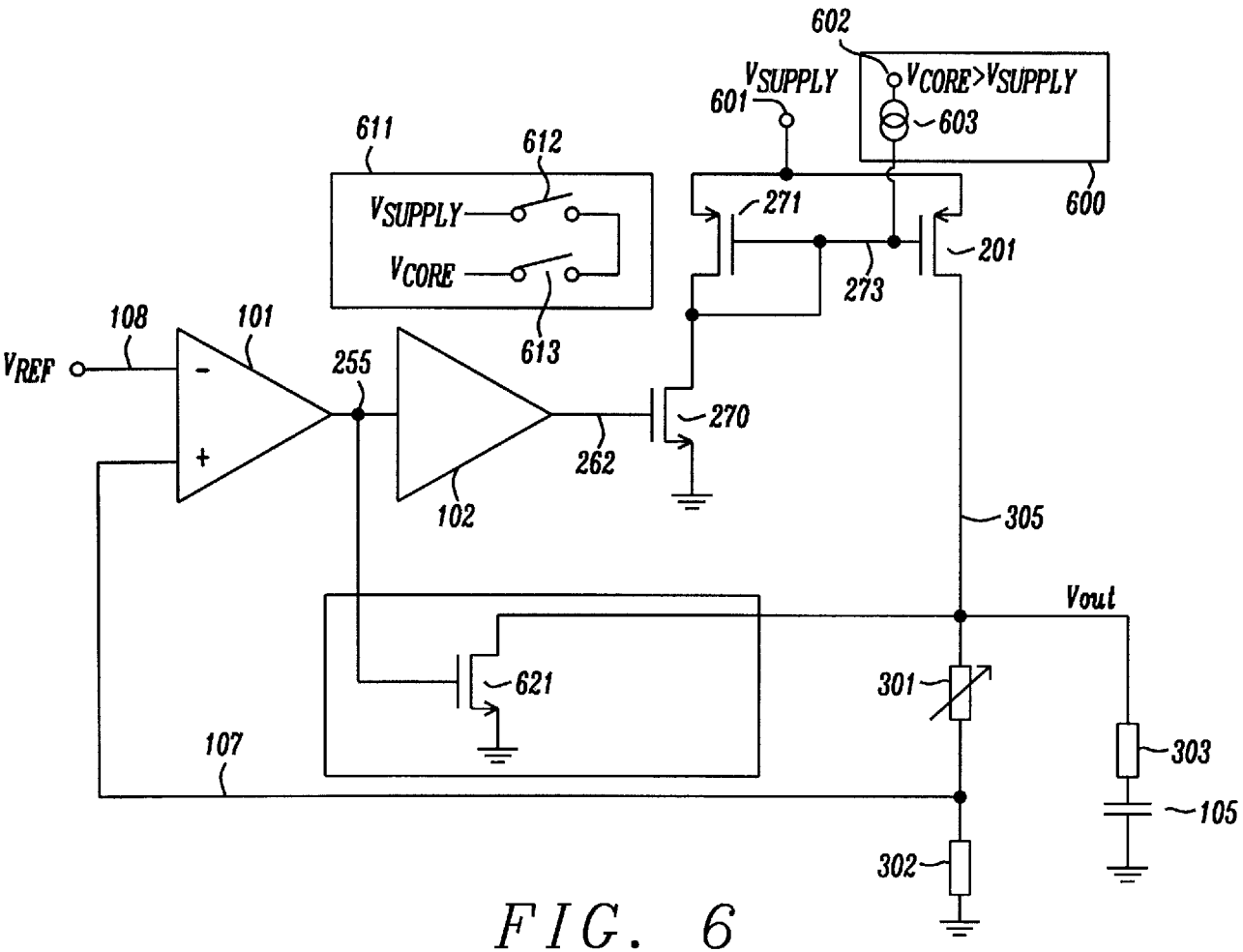
FIG. 6 shows an LDO regulator comprising circuitry for reducing and/or compensating leakage current.

FIG. 6 shows a block diagram of a multi-stage amplifier or regulator 200 comprising circuitry 600 for reducing the leakage current of the pass device 201 using the above mentioned principle. In the illustrated example, the pass device 201 is a P-type MOS transistor, wherein the source of the pass device 201 is coupled to the supply voltage $V_{SUPPLY}$ of the multi-stage amplifier 200. The leakage reduction circuitry 600 is configured to couple or to pull-up the gate 273 of the pass device 201 to a core voltage $V_{CORE}$ which is higher than the supply voltage $V_{SUPPLY}$, $V_{CORE}>V_{SUPPLY}$. The leakage reduction circuitry 600 may comprise a (e.g. fixed) current source 603 for setting the voltage level at the gate 273 of the pass device 201. As such, the circuitry 600 may be configured to pre-set the source-gate voltage $V_{GS}$ at the pass device 201 to a negative value (when the multi-stage amplifier is in OFF state), thereby reducing the leakage current 401 through the pass device 201 (as shown in FIG. 4).

On the other hand, the leakage reduction circuitry 600 does not negatively affect the regulation of the output voltage $V_{OUT}$ at the output node 305, because the negative offset of the voltage at the gate 273 of the pass device 201 is automatically taken into account within the regulation loop. Hence, the leakage reduction circuitry 600 is included within the regulation loop of the multi-stage amplifier 200.

During normal operation, when the load current which is provided at the output node 305 is higher than zero, the drive circuitry 270, 271 of the multi-stage amplifier 200 will typically be dominant for determining the voltage level at the gate 273 of the pass device 201 and for regulating the output voltage $V_{OUT}$ at the output node 305. On the other hand, when the load current is zero, the current through the drive circuitry 270, 271 will typically also be zero. In this case, the current mirror 271, 201 which is connected to the gate 273 of the pass device 201 will typically charge up the gate 273 up to the core voltage $V_{CORE}$ 602 which is higher than the supply voltage $V_{SUPPLY}$ 601 connected to the sources of the drive transistor 271 and of the pass device 201. This will result is a negative source-gate voltage 402 at the pass device 201, thereby reducing the leakage. The amount of reduction of the leakage typically depends on the difference between the core voltage $V_{CORE}$ 602 and the supply voltage $V_{SUPPLY}$ 601.

Even though a negative source-gate voltage 402 as in FIG. 4 is applied to the pass device 201 within the zero load case, there may still be some leakage depending on the temperature 501 as in FIG. 5 and/or the process corner of the pass device 201. This leakage will typically be relatively small but may, in some cases, cause loss of regulation. In order to prevent this, a current sink 621 as in FIG. 6 (also referred to as a sink transistor) may be used. The current sink 621 may be used alternatively to or in addition to the leakage reduction circuitry 600. The current sink 621 may be adjusted depending on the output voltage of the first differential pair 101 (i.e. based on the output voltage of the differential amplification stage 101). If the output voltage $V_{OUT}$ at the output node 305 increases due to remaining leakage of the pass device 201, the output voltage of the differential amplification stage 101 also increases, thereby opening the current sink 621 and thereby pulling more current from the output node 305 to compensate for the leakage. As such, the current sink 621 of FIG. 6 provides regulated means for compensating leakage of the pass device 201.

The multi-stage amplifier may alternatively or further comprise means 611 for preventing vertical bipolar activation within the drive transistor 271. In particular, the multi-stage amplifier may comprise means 611 for coupling the bulk of the drive transistor 271 and/or of the pass device 201 to the supply voltage $V_{SUPPLY}$ 601 and/or to the core voltage $V_{CORE}$ 602. Using a switch 612, the bulk of the drive transistor 271 and/or of the pass device 201 may be coupled to the supply voltage $V_{SUPPLY}$ 601, when the multi-stage amplifier is in ON state. Using a switch 613, the bulk of the drive transistor 271 and/or of the pass device 201 may be coupled to the core voltage $V_{CORE}$ 602, when the multi-stage amplifier is in OFF state. As such, a switch multiplexer 612, 613 may be used to either connect the bulk of the drive stage 271 to the core voltage 602 or to the supply voltage 601, in order to prevent vertical bipolar activation in OFF state. The bulk switches 612, 613 may ensure a safe turn off and may prevent leakage at OFF state.

Figure 7:
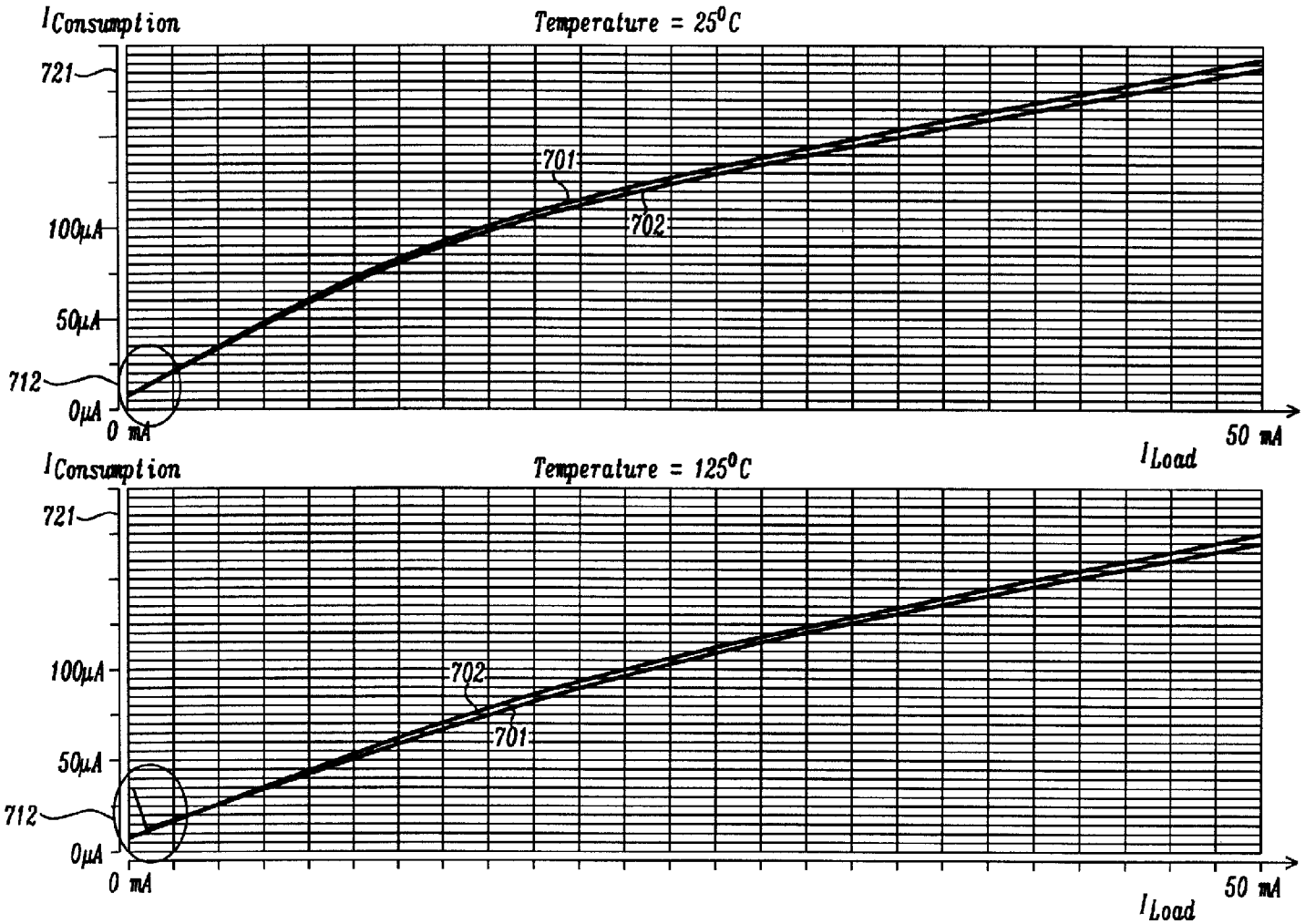
FIG. 7 shows example leakage currents as a function of the load current of an LDO regulator.

FIG. 7 shows example simulation results for a low voltage multi-stage amplifier implemented using a 0.13μ process. In particular, FIG. 7 shows current consumption 721 for a supply voltage $V_{SUPPLY}$=1.4V, for an output voltage $V_{OUT}$=1V and for a core voltage $V_{CORE}$=1.5V for different load currents 711 ranging from 0 mA to a maximum of 50 mA. The upper graphs relate to a temperature of 25° C. and the lower graphs relate to a temperature of 125° C. Current Consumption is shown for the case when using the leakage reduction/compensation means shown in FIG. 6 (graphs 701) and for the case when not using the leakage reduction/compensation means shown in FIG. 6 (graphs 702). It can be seen that a substantial reduction of the leakage current 401 may be achieved at relatively high temperatures (125° C.) and at relatively low load currents (see notably lower circle 712). This is the range where leakage 401 is a dominant portion within the current consumption 721 of the pass device 201.

As such, leakage may be reduced using the circuitry described in the present document. At the same time, it has been verified that a stable regulation and a fast transient response may be achieved using the circuitry described in the present document. Furthermore, it has been verified that pass device gate pull-up circuitry 600 (which is implemented as a current mirror in FIG. 6) may be implemented using a resistor, notably a resistor having a relatively high value (e.g. 10 k-100 k).

Figure 8:
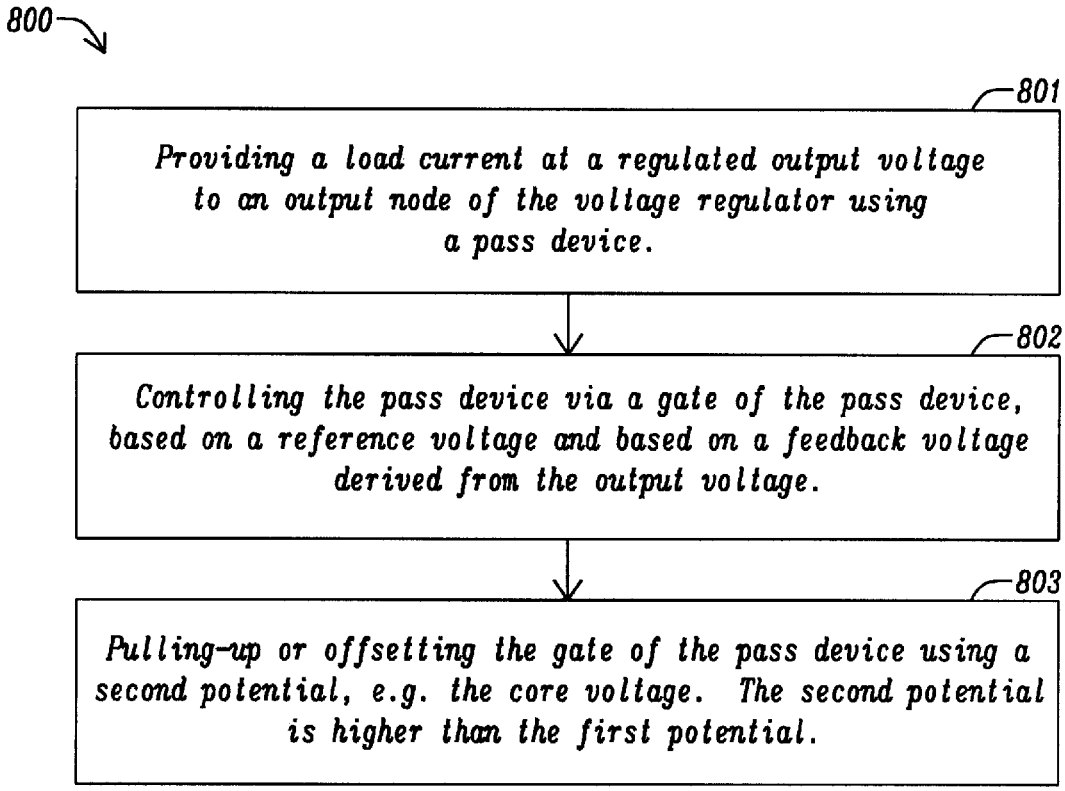
FIG. 8 shows a flow chart of an example method for reducing leakage current of a multi-stage amplifier.

FIG. 8 shows a flow chart of an example method 800 for reducing leakage of a pass device 201 of a voltage regulator 200. The method 800 comprises providing 801 a load current at a regulated output voltage to an output node 305 of the voltage regulator 200 using a pass device 201. For this purpose, a source of the pass device 201 is coupled to a first potential 601, e.g. to the supply voltage $V_{SUPPLY}$, of the voltage regulator 200. Furthermore, the method 800 comprises controlling 802 the pass device 201 via a gate 273 of the pass device 201, based on a reference voltage 108 and based on a feedback voltage 107 derived from the output voltage. By doing this, the load current at the regulated output voltage may be provided. In particular, the output voltage may be regulated in accordance to the reference voltage. In addition, the method 800 comprises pulling-up or offsetting 803 the gate of the pass device 201 using a second potential 602, e.g. the core voltage $V_{CORE}$. The second potential 602 is higher than the first potential 601. By doing this, the source-gate voltage of the pass device 201 may be offset using a negative offset, thereby reducing leakage of the pass device 201.

In the present document, various means for reducing/compensating leakage of a pass device 201 have been described. In particular, circuitry 600 has been described which applies a negative $V_{GS}$ to the pass device 201 when needed, i.e. notably at low or zero load current conditions where leakage is of significant importance. Furthermore, circuitry 621 has been described which draws a current that is proportional to the remaining leakage of the pass device 201, even when a negative $V_{GS}$ is applied. In addition, bulk switches 612, 613 have been described which ensure safe OFF operation of the multi-stage amplifier.

The proposed means for leakage reduction/compensation provide various advantages. Leakage may be reduced up to 85% at a temperature of 125° C. by applying negative $V_{GS}$ to the pass device 201. Furthermore, a remaining small amount of leakage may be compensated using a current sink 621. In addition, the OFF state leakage may be eliminated, thereby preventing unnecessary power consumption using bulk switches 612, 613. Furthermore, safe shutdown may be ensured using the bulk switches 612, 613 connected to the drive circuitry 270, 271.

It should be noted that the description and drawings merely illustrate the principles of the proposed methods and systems. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A multi-stage voltage regulator comprising a pass device configured to provide a load current at a regulated output voltage to an output node of the voltage regulator; wherein a source of the pass device is coupled to a first potential of the voltage regulator;

a differential amplification stage configured to derive a first intermediate voltage at a stage output node of the differential amplification stage, based on a difference between a reference voltage and a feedback voltage derived from the output voltage;

an intermediate amplification stage configured to derive a second intermediate voltage at a stage output node of the intermediate amplification stage, based on the first intermediate voltage;

drive circuitry configured to control the pass device via a gate of the pass device, wherein the drive circuitry is coupled to the stage output node of the intermediate amplification stage;

leakage reduction circuitry configured to pull-up the gate of the pass device using a second potential; wherein the second potential is higher than the first potential leakage compensation circuitry configured to sink a current from the output node to a reference potential of the voltage regulator;

wherein an amount of current which is sunk by the leakage compensation circuitry depends on the first intermediate voltage, the leakage compensation circuitry comprises a sink transistor arranged between the output node and the reference potential, and a gate of the sink transistor is connected to the stage output node of the differential amplification stage.

2. The voltage regulator of claim 1, wherein the leakage reduction circuitry comprises a current source which couples the gate of the pass device to the second potential; and/or a resistor which couples the gate of the pass device to the second potential.

3. The voltage regulator of claim 1, wherein the leakage reduction circuitry is configured to offset a source-gate voltage at the pass device by a negative offset; wherein the negative offset depends on the second potential and on the first potential, e.g. on a difference between the second potential and the first potential.

4. The voltage regulator of claim 1, wherein the drive circuitry comprises an input transistor and a drive transistor;

a gate of the input transistor is coupled to the stage output node of the intermediate amplification stage;

the input transistor and the drive transistor are arranged in series; and a gate of the drive transistor is coupled to the gate of the pass device.

5. The voltage regulator of claim 1, wherein the drive circuitry is configured to generate a gate voltage for the gate of the pass device based on the reference voltage and based on the feedback voltage, e.g. based on a difference between the reference voltage and the feedback voltage.

6. The voltage regulator of claim 1, wherein the drive circuitry comprises a drive transistor which forms a current mirror in conjunction with the pass device;

the drive transistor comprises a bulk;

the voltage regulator comprises one or more bulk switches which are configured to couple the bulk of the drive transistor to the first potential and/or to the second potential.

7. The voltage regulator of claim 6, wherein the voltage regulator comprises logic circuitry configured to control the one or more bulk switches such that the bulk of the drive transistor is coupled to the first potential, when the voltage regulator is in ON state, and to the second potential, when the voltage regulator is in OFF state.

8. The voltage regulator of claim 1, wherein the load current is drawn through the pass device from the first potential; and a drain of the pass device is coupled to the output node.

9. The voltage regulator of claim 1, further comprising a voltage divider configured to derive the feedback voltage based on the output voltage.

10. The voltage regulator of claim 1, further comprising an output capacitor arranged between the output node and a reference potential of the voltage regulator.

11. The voltage regulator of claim 1, wherein the pass device comprises a P-type metaloxide semiconductor, referred to as MOS, transistor.

12. A method for reducing leakage of a pass device of a multi-stage voltage regulator, the method comprising, providing a load current at a regulated output voltage to an output node of the voltage regulator using a pass device; wherein a source of the pass device is coupled to a first potential of the voltage regulator;

providing a differential amplification stage to derive a first intermediate voltage at a stage output node of the differential amplification stage, based on a difference between a reference voltage and afeedback voltage derived from the output voltage;

providing an intermediate amplification stage configured to derive a second intermediate voltage at a stage output node of the intermediate amplification stage, based on the first intermediate voltage;

providing leakage compensation circuitry to sink a current from the output node to a reference potential of the voltage regulator;

wherein an amount of current which is sunk by the leakage compensation circuitry depends on the intermediate voltage, the leakage compensation circuitry comprises a sink transistor arranged between the output node and the reference potential, and a gate of the sink transistor is connected to the stage output node of the differential amplification stage;

controlling the pass device via a gate of the pass device, based on the stage output node of the intermediate multiplication stage; and pulling-up the gate of the pass device using a second potential; wherein the second potential is higher than the first potential.

13. The method for reducing leakage of a pass device of a voltage regulator of claim 12, wherein the leakage reduction circuitry comprises a current source which couples the gate of the pass device to the second potential; and/or a resistor which couples the gate of the pass device to the second potential.

14. The method for reducing leakage of a pass device of a voltage regulator of claim 12, wherein the leakage reduction circuitry offsets a source-gate voltage at the pass device by a negative offset; wherein the negative offset depends on the second potential and on the first potential, e.g. on a difference between the second potential and the first potential.

15. The method for reducing leakage of a pass device of a voltage regulator of claim 12, wherein the drive circuitry comprises an input transistor and a drive transistor;

a gate of the input transistor is coupled to the stage output node of the intermediate amplification stage;

the input transistor and the drive transistor are arranged in series; and a gate of the drive transistor is coupled to the gate of the pass device.

16. The method for reducing leakage of a pass device of a voltage regulator of claim 12, wherein the drive circuitry generates a gate voltage for the gate of the pass device based on the reference voltage and based on the feedback voltage, e.g. based on a difference between the reference voltage and the feedback voltage.

17. The method for reducing leakage of a pass device of a voltage regulator of claim 12, wherein the drive circuitry comprises a drive transistor which forms a current mirror in conjunction with the pass device;

the drive transistor comprises a bulk;

the voltage regulator comprises one or more bulk switches to couple the bulk of the drive transistor to the first potential and/or to the second potential.

18. The method for reducing leakage of a pass device of a voltage regulator of claim 17, wherein the voltage regulator comprises logic circuitry to control the one or more bulk switches such that the bulk of the drive transistor is coupled to the first potential, when the voltage regulator is in ON state, and to the second potential, when the voltage regulator is in OFF state.

19. The method for reducing leakage of a pass device of a voltage regulator of claim 12, wherein the load current is drawn through the pass device from the first potential; and a drain of the pass device is coupled to the output node.

20. The method for reducing leakage of a pass device of a voltage regulator of claim 12, wherein the pass device comprises a P-type metaloxide semiconductor, referred to as MOS, transistor.

* * * * *